United States Patent [19]

Pehker et al.

[11] Patent Number: 4,693,166

[45] Date of Patent: Sep. 15, 1987

[54] AMMUNITION RACK FOR VERTICALLY STANDING CARTRIDGE AMMUNITION

[75] Inventors: Manfred Pehker; Edelgard Pahlke, both of Duesseldorf; Josef Metz, Neuss, all of Fed. Rep. of Germany

[73] Assignee: Rheinmetall GmbH, Duesseldorf, Fed. Rep. of Germany

[21] Appl. No.: 757,810

[22] Filed: Jul. 22, 1985

[30] Foreign Application Priority Data

Jul. 20, 1984 [DE] Fed. Rep. of Germany ..... 3426761

[51] Int. Cl.[4] ..... F41F 9/00; A47F 5/08

[52] U.S. Cl. ..... 89/34; 89/36.01; 206/3; 211/100; 211/60.1

[58] Field of Search ..... 89/34, 33.03, 33.04, 89/33.05, 45, 46, 36.01, 36.03, 47, 36.08, 36.13; 206/3; 211/60.1, 89, 100

[56] References Cited

U.S. PATENT DOCUMENTS

| | | | |
|---|---|---|---|
| 2,456,620 | 12/1948 | Chadwick et al. | 89/47 |
| 2,822,730 | 2/1958 | Brennan et al. | 89/45 |
| 4,125,052 | 11/1978 | Thomas | 89/34 |
| 4,263,837 | 4/1981 | Tassie | 89/34 |
| 4,429,616 | 2/1984 | Grosser | 89/32 |
| 4,481,862 | 11/1984 | Wiethoff et al. | 89/46 |

FOREIGN PATENT DOCUMENTS

| | | | |
|---|---|---|---|
| 2433568 | 1/1976 | Fed. Rep. of Germany | 89/46 |
| 3208169 | 9/1983 | Fed. Rep. of Germany | 89/46 |
| 23519 | of 1909 | United Kingdom | 89/45 |

*Primary Examiner*—Deborah L. Kyle
*Assistant Examiner*—Michael J. Carone

[57] ABSTRACT

The invention relates to an ammunition rack for vertically storing cartridge ammunition in the ready room of the loader on the turret platform of a tank and removing the ammunition therefrom; the rack having a stay tube for centering the cartridge base and a clamping device for fastening the projectile. The clamping device can be pivoted upwardly around a turret fixed pivot by way of a holding lever upon removal of the projectile after the clamping device has been released and the ammunition unit has been removed therefrom.

7 Claims, 5 Drawing Figures

AMMUNITION RACK FOR VERTICALLY STANDING CARTRIDGE AMMUNITION

BACKGROUND OF THE INVENTION

In order to store vertically standing cartridged ammunition in large quantities, it is necessary to protect the shock sensitive combustible cartridge casings against damage within a comparably compact ready room of the loader of a tank. It is also necessary to nevertheless guarantee the malfunction-free removal of the ammunition from the loading device, particularly with successively arranged rows of ammunition.

It is known that conventional ammunition with metal cartridges for tank cannons is stored in an ammunition rack in the ready room of the loader on the turret platform. In a battle tank, for example, the ammunition is vertically stored on the cartridge base in a stay tube on the storage side of the loader. On the projectile side each round of ammunition is held in position by a clamping device which pivots upwardly upon removal of each successive round. This type of ammunition rack and loader results in rapid and complex automatic handling of ammunition for delivery to the tank cannon under battle conditions. When cartridges having a combustible casing are used, it is necessary to specially protect the ammunition from damage or destruction due to its shock-sensitivity by way of special storage means. To achieve secure protection, it is common practice to store ammunition with combustible cassings horizontally, in special ammunition cans (bushings) comprising magazines, which in turn are arranged, for example, in the rear of the turret separate from the loading device.

When vertically storing as large a number as possible of ammunition with combustible cassings in a ready firing condition on the loader side of the turret platform, in the same manner as metal casing ammunition, for instance on a compact turret platform of a battle tank, the conventional ammunition rack offers no protection against external forces for the combustible cartridge, casing of stored ammunition. In particular, there is little or no protection against unintentional impact or accidental damage caused by service personnel while handling the ammunition. Furthermore, in known clamping devices the only free space available for the removal of ammunition is limited in height, particularly with regard to rear rows of ammunition. The conventional clamping device pivots upwardly when used with multiple successively arranged rows of ammunition, and the available space for removal, transfer, and delivery of ammunition is limited because the lower half of the clamping device, rigidly joined with the holding lever, limits the height of the free space after the upward swivel around a turret fixed pivot.

SUMMARY OF THE INVENTION

It is an object of the invention to provide an improved ammunition rack located in a comparably compact ready room of the turret platform of a tank. According to the invention, ammunition units with combustible casings are protectively arranged in large numbers, vertically standing, in an apparatus which isolates the shock sensitive cartridge casing from external forces and prevents their damage or destruction. It is another object of the invention to guarantee efficient and trouble-free removal of the ammunition from the rack within a compact space, as in successive rows of ammunition arranged in the ready room of a tank turret.

These and other objects of the invention will become apparent to the skilled practitioners by reference to the accompanying drawings, description, and claims.

The present ammunition rack provides a clamping device and protection shield connected to a stay tube. These elements, and the manner in which they are arranged, advantageously guarantee that each ammunition unit is held in a secure holding position, while also insuring optimal protection for a combustible and shock sensitive cartridge casing.

Another advantage of the invention is an increase in the free space available for the loading and unloading of rear ammunition rows. This is achieved by selectively pivoting the clamping device around the free end of a holding arm. In the upwardly pivoted position of the holding arm the base of the clamping device does not diagonally project into the ready room, as it does in known clamping devices which are rigidly attached on the holding arm. Instead of reducing the available space, the clamping device of the invention occupies a very nearly vertical position parallel to the holding arm. The complete ammunition rack may be arranged around an angle tilted towards the turret wall, which also enlarges the available ready room for the loader.

The present ammunition rack is also advantageous because of the simplicity of its operation. While the clamping device, with manual rotation, automatically locks in and out of respective holding and rest positions; the protection shield, after unlocking by way of a foot pedal, can be manually turned in front of the rear rows of ammunition, to provide desirable protection.

BRIEF DESCRIPTION OF THE DRAWINGS

The invention is explained in detail on the basis of the example illustrated in the drawing, wherein there is illustrated.

Detailed Description

Figure 1:
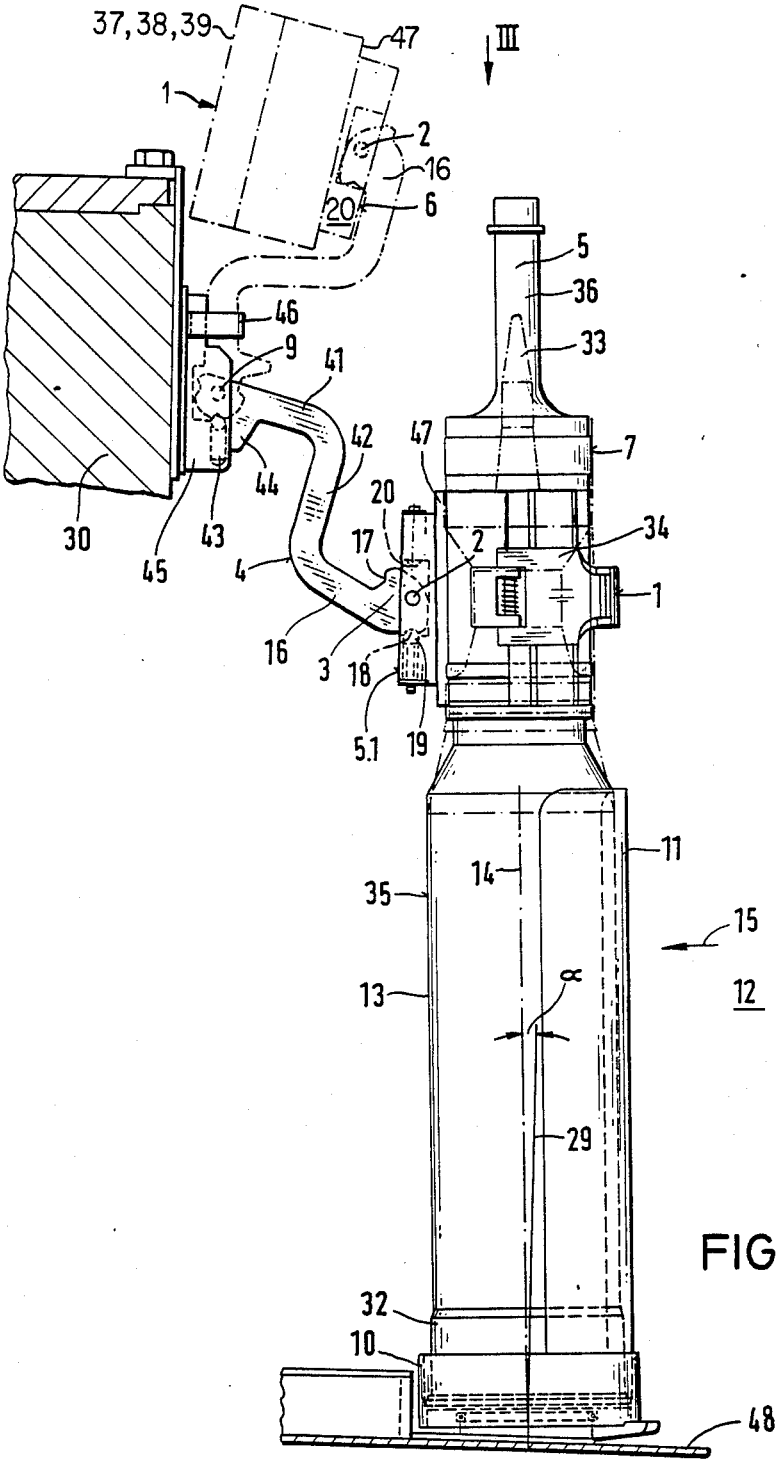
FIG. 1 is a side view of an ammunition holding device with a stored ammunition unit.

FIG. 1 shows an ammunition rack 31 (FIG. 3) consisting of a clamping device 1 and rotating stay tube 10 for the attachment of a vertically standing stored ammunition unit 7 within the ready room 12 in a holding position 5 (FIG. 1). The ammunition unit 7 can be prepared as multiple purpose ammunition 36, or can be equipped with a subcaliber projectile 33 and a sabot 34 shown by dotted line outline in FIG. 1, whereby each projectile is mounted on the front end of a propellant charge casing 35. The cartridge base 32 of the propellant charge casing 35 rests upon a support plate 28 (FIG. 2) of a stay tube 10 centered under the ammunition unit 7 and revolving around the longitudinal axis 14 of the ammunition unit 7, which, for the protection of the side 15 of the combustible cartridge casing 13 facing the ready room 12, is equipped with a protection shield 11 which surrounds (encloses) the whole length and nearly half the circumference of the cartridge casing 13.

Two holding clamps 37,38 (FIG. 3) of the clamping device 1, which can pivot outwardly, are mounted on both sides of a half dish forming the receiver tray 47 and serve to lockingly hold the ammunition unit 7. In a commonly known manner the ammunition unit 7 is held by means of a breech clasp 39 (FIG. 3) in the holding position 5 on the projectile side, respectively, which can be opened for the storage or removal of the ammunition unit 7 and which thereafter automatically swivel back to assume the holding position 5 via recuperator springs 40.

The clamping device 1 is mounted inside the loader (not shown) of the ready room 12, for example on the turret platform of a (likewise not pictured) battle tank. The clamping device 1 is connected with the turret wall 30 on the projectile side by way of a holding lever 4. The clamping device 1 is thereby arranged so that it can pivot about joint 2, which is fastened to a bracket 3 and is disposed opposite the turret fixed pivot 9 of the holding lever 4.

Figure 5:
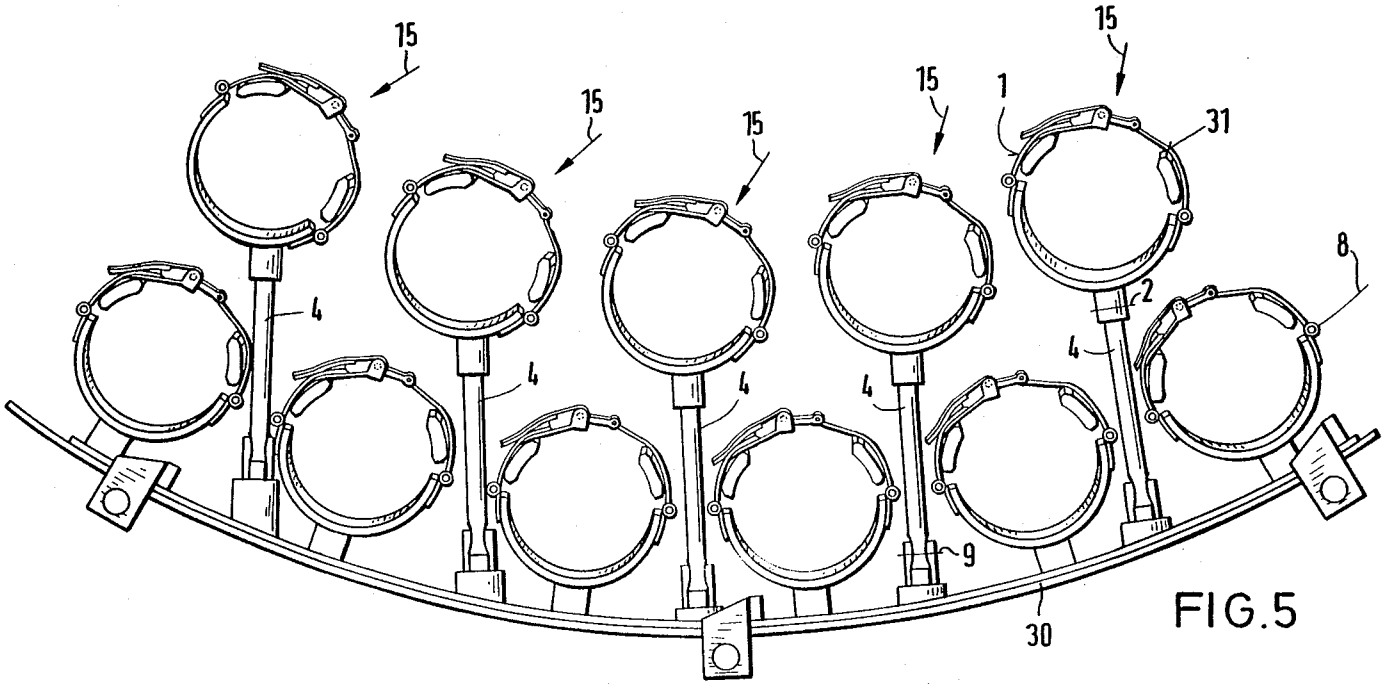
FIG. 5 is a top view showing the double row of successive ammunition racks as mounted in the ready room.

The clamping device 1 can be pivoted about the joint 2 from an adjustable position 5.1 to an adjustable storage rest position 5.1. The ammunition unit 7 can be moved from a corresponding storage position in which the ammunition is held by the clamping device 1 or for removal of stored ammunition 7, in particular from the successive back rows 8 (FIG. 5).

For this purpose the bracket 3 of the holding lever 4 contains notches 17,18, equidistant and radially oriented with respect to the joint 2, whereby the notch 17 is arranged on the pivot side in such a way that the clamping device 1 can lock into the locking position 6 lying parallel to the adjoining arm 16 of the holding lever 4 (FIG. 1); and the notch 18 is arranged on the bracket 3 on the outer side on the end of the arm 16 in such a way that the clamping device 1 can lock into the corresponding position while maintaining the holding position 5 for the ammunition unit 7 by means of a not further illustrated detent 19, 20 (FIG. 1).

For the purpose of locking into the notches 17,18 the clamping device 1 contains spring detent holding devices 19,20, on two sides opposite of the joint 2, that the bracket 3 can be locked into via the notches 17,18 into two positions, angularly spaced from each other and lying in the plane of the longitudinal axis 14.

The arm 4 is constructed as an elbow and consists, next to the arm section 16, of an arm section 41 mounted on a pivot 9 and a center piece 42 connecting the arm sections 16,41; whereby the arm section 41, in the holding position 5, abuts against a plate 45 on the turret wall side by way of its stop 44 and is secured by way of a pin 43 which can be locked in. In the lock-in position 6 the arm section 41 abuts against the plate 45 which is likewise held by the pin 43 and by a clamping device 46.

The ammunition rack 31 and the stay tube 10 can be arranged in such a way in the ready room or chamber 12 that the middle axis 14 of the ammunition unit 7 is preferably inclined with respect to a plane 29 which is perpendicular with respect to the turret basket bottom 48 making an angle $\alpha$ therewith which is preferably smaller than 5°.

Figure 2:
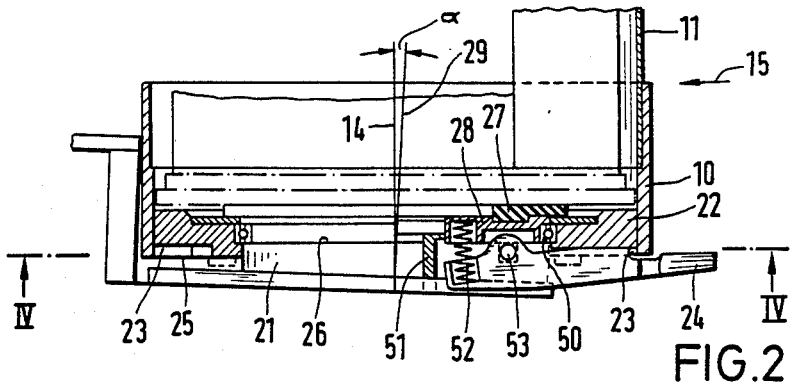
FIG. 2 is a cross section along the plane II—II shown in FIG. 3, showing the lower portion of the stay tube with protection shield.

FIG. 2 illustrates in detail the construction of the stay tube 10 which is connected to the turret basket wall 49 (FIG. 3) and is rotatable about the longitudinal axis 14. The stay tube 10 is connected in a non-illustrated matter in its upper region with the protective shield 11 and in its lower region is ridigly connected with the bearing ring 22 by means of screws 58, whereby the bearing ring 22 is rotatably mounted on its inner side on a radial bearing 50 disposed between the receiving upper portion 28 and the receiving lower portion 21 of the stay tube 10. The receiving upper portion 28 is centered by means of a bushing 51 with respect to the receiving lower portion 21. The bearing ring 22 contains on the periphery of its bottom side 25 a plurality of evenly distributed grooves 23 which extend radially from the side 15 and are spaced equiangularly at an angle $\beta$ from each other, which is preferably 90° (FIG. 4). The grooves 23 extend radially with respect to the longitudinal axis 14 and are adapted tto operatively receive the upper portion of a foot lever 24 mounted on the lower portion 21. By actuating the foot lever 24, a safety position is released in the groove 23, so that the protective shield 11 can be manually turned, preferably about 90°, respectively 180° about the longitudinal axis 14 in the direction of the turret basket wall 29, until such rotation is limited by non-illustrative stops when the shield has exactly reached a predetermined end position.

The upper surface 26 of the receiving portion 21 is constructed in such a way that it forms a skewed plane; an inclination is achieved as well with respect to the longitudinal axis 14 of the ammunition 7, as well as with respect to a rubber surface 27 and the turret basket fixed-receiving-portion 21 which bears on the receiving portion 28, as well with respect to the middle axis of the rotatable stay tube 10 and protection shield 11 and bearing ring 22 relative to the longitudinal axis 14. Such arrangement enlarges the free space of the ready chamber 12 and such inclination is determined by means of the angle of inclination $\alpha$ with respect to the plane 29.

Figure 3:
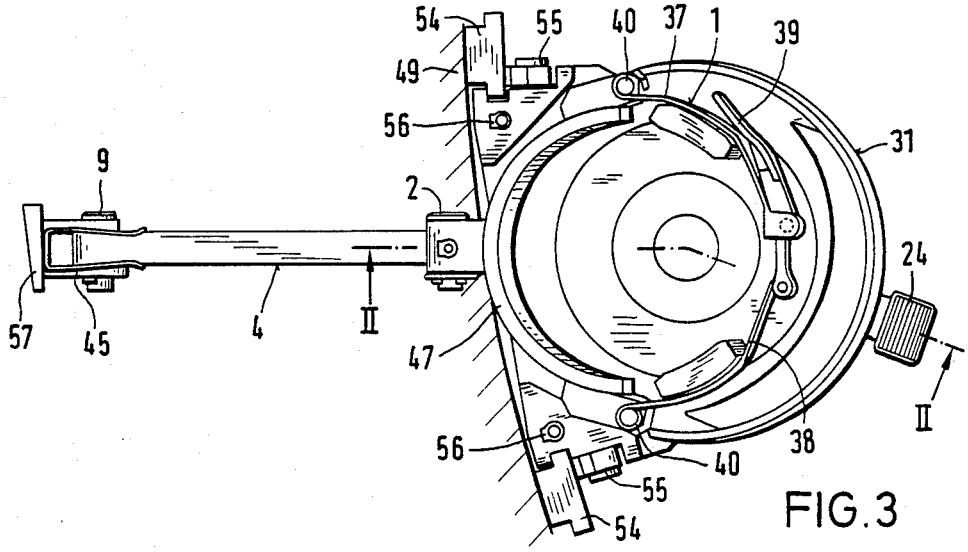
FIG. 3 is a top view of the ammunition rack of FIG. 1 as seen in the direction of arrow III.
Figure 4:
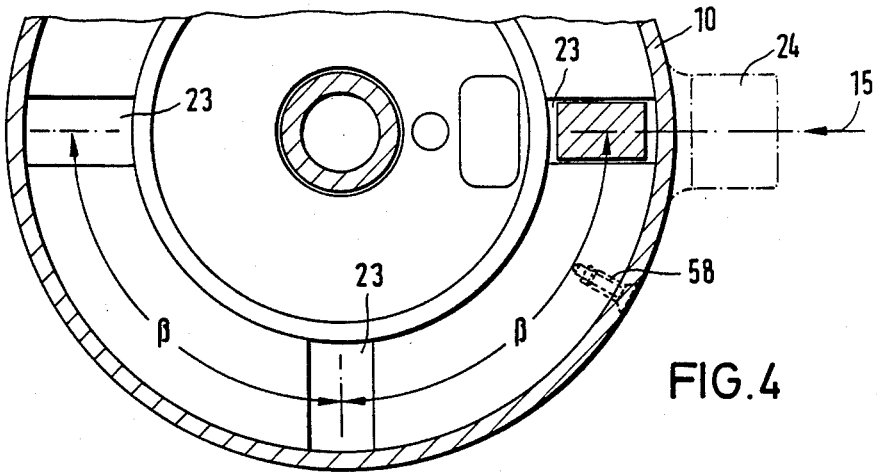
FIG. 4 is a cross section along the plane IV—IV indicated in FIG. 2, showing the bearing ring of the stay tube with an arrangement of guide grooves for the foot pedal.

As can be seen from FIG. 3, the stay tube 10 is bilaterally secured to the turret basket wall 49 via guide members 54 and is fixable by a non-illustrated-in-detail catch 55. Spring legs 56 are supported on the turret basket bottom 48 (FIG. 1) which favor the removability of the stay tube 10 from the guide grooves after the catch 55 has been manually disengaged.

As can be particularly seen from FIG. 5, the position of the side 15 of each ammunition unit 7 which is to be protected can be changed by the position of the loader in the ready chamber 12; the protective shield 11 is mounted in all cases of the inner row of stored ammunition units 7 in the holding position 5 (FIG. 1) so as to confront the loader. FIG. 3 illustrates such an arrangement of ammunition holder 31. For achieving a mutually parallel arrangement of the holder levers 4 and the mounting arrangement bracket 57, the supports 55 are individually adapted to the circularly shaped turret wall curvature.

The foot lever 24 which has an upper portion engaging in a groove 23 while in the holding position 5 (FIG. 1) is also illustrated in FIG. 4. Depending on the position of the side 15 which is to be protected, ammunition units 7 during loading and removal have a protective shield which is rotatable about the angle $\beta=90°$, respectively, $\beta=180°$ in the direction toward the turret wall 30.

Although the invention is described and illustrated with reference to a single embodiment thereof, it is to be expressly understood that it is is no way limited to the disclosure of such preferred embodiment but is capable of numerous modifications within the scope of the appended claims.

We claim:

1. An improved ammunition rack arrangement for storing vertically standing cartridge ammunition units in the ready room of the loader on the turret platform of a tank and for removing the units therefrom; the ammunition rack having a ready room side, a stay tube for centering the cartridge base, and a clamping device for holding the ammunition unit, wherein the improvement comprises:

a stay tube having a protection shield operatively mounted thereon for protecting the side of a combustible cartridge shaft which faces the ready room, said shield being movably mounted about the longitudinal axis of the ammunition unit for removal of said unit via the ready room side;

a clamping device pivotally connected via a joint to a bracket of a holding lever having a pair of opposite ends to one of its ends; said holding lever being pivotally mounted at the opposite end to a turret fixed pivot; the clamping device being arranged to move between a locked holding position and a locked removal position.

2. An improved ammunition rack according to claim 1, wherein the top of the holding lever has notches for the selective locking adjustment of the clamping device in a locked position lying parallel to an arm adjoining the holding lever, the notches being arranged equidistant and radially with respect to the joint on the pivot side of the holder lever, and biasing means operatively coacting with said holding lever.

3. An improved ammunition rack according to claim 1, wherein each ammunition unit has a cartridge shaft and the protection shield encloses the entire length and nearly half the circumference of the cartridge shaft.

4. An improved ammunition rack according to claim 3, wherein the stay tube has a lower receiving part fixed on a turret holder and a bearing ring positioned over this lower receiving part, the lower receiving part thereby revolving around and connected with the protection shield in cooperation with a lower part in which quide grooves are disposed which extend radially with respect to the longitudinal axis of the ammunition unit, said lower receiving part incluing a pivotable locking foot pedal.

5. An improved ammunition rack according to claim 4, wherein the guide grooves are positioned on the circumference of the lower part of the bearing ring and are arranged so as to radially equiangularly extend about the longitudinal axis of the bearing ring from the ready room side.

6. An ammunition rack according to claim 5, wherein the angular distance between adjacent guide grooves is 90 degrees.

7. An ammunition rack according claim 6, wherein an upper surface of the lower receiving part forms a plane skewed with respect to the longitudinal axis of the ammunition unit, said unit being supported on a rubber support, and with respect to an upper receiving part which rests on the lower receiving part, and further with respect to a central axis of the rotating stay tube, protection shield, and bearing ring, said plane, longitudinal axis and central axis all being tilted at an angle of inclination with respect to a turret wall in the free space of the ready room, which inclination is determined relative to a straight line which is normal with respect to a turret holder base.

* * * * *